US009103067B2

(12) United States Patent
Jung

(10) Patent No.: US 9,103,067 B2
(45) **Date of Patent: *Aug. 11, 2015**

(54) TEXTILE FABRIC SHEET HAVING STAIN AND LIQUID RESISTANCE AND THE PREPARATION METHOD THEREOF

(76) Inventor: Soon Kie Jung, Saddle River, NJ (US)

( * ) Notice: Subject to any disclaimer, the term of this patent is extended or adjusted under 35 U.S.C. 154(b) by 70 days.

This patent is subject to a terminal disclaimer.

(21) Appl. No.: 13/468,560

(22) Filed: May 10, 2012

(65) Prior Publication Data

US 2013/0035012 A1 Feb. 7, 2013

Related U.S. Application Data

(63) Continuation-in-part of application No. 13/197,986, filed on Aug. 4, 2011, now Pat. No. 8,795,780.

(51) Int. Cl.

| | |
|---|---|
| ***D06N 3/12*** | (2006.01) |
| ***D06N 3/18*** | (2006.01) |
| ***D06N 3/14*** | (2006.01) |

(52) U.S. Cl.

CPC ..... *D06N 3/128* (2013.01); *D06N 3/14* (2013.01); *D06N 3/143* (2013.01); *D06N 3/145* (2013.01); *D06N 3/183* (2013.01); *D06N 2209/123* (2013.01); *D06N 2209/128* (2013.01); *D06N 2209/142* (2013.01); *D06N 2209/145* (2013.01); *D06N 2209/147* (2013.01); *D06N 2213/03* (2013.01)

(58) Field of Classification Search

USPC ..... 442/79, 80, 93; 427/358

See application file for complete search history.

(56) References Cited

U.S. PATENT DOCUMENTS

| | | | | |
|---|---|---|---|---|
| 5,747,392 | A * | 5/1998 | Xiao et al. | 442/82 |
| 5,902,753 | A | 5/1999 | DeMott et al. | |
| 8,795,780 | B2 * | 8/2014 | Jung | 427/356 |
| 2003/0041808 | A1 | 3/2003 | Wulforst et al. | |
| 2008/0124368 | A1 * | 5/2008 | Sarangapani | 424/405 |
| 2009/0077704 | A1 | 3/2009 | Duncan et al. | |

FOREIGN PATENT DOCUMENTS

| | | | |
|---|---|---|---|
| CN | 1453422 | A | 11/2003 |
| CN | 101250820 | A | 8/2008 |
| CN | 101638512 | A | 2/2010 |
| JP | 61199945 | A | 9/1986 |
| JP | 06031871 | A | 2/1994 |

(Continued)

OTHER PUBLICATIONS

International Searching Authority, International Search Report issued in corresponding International Application No. PCT/KR2012/003513, dated Nov. 23, 2012.

(Continued)

*Primary Examiner* — Lynda Salvatore
(74) *Attorney, Agent, or Firm* — Sughrue Mion, PLLC

(57) ABSTRACT

Provided are a textile fabric sheet having stain and liquid resistance including a fabric sheet, a polyurethane coating layer formed on the fabric sheet and a stain-resistant coating layer formed on the polyurethane coating layer and a method of preparing the same. Thus, a texture characteristic of the fabric substrate itself can be exhibited, and due to the polyurethane coating layer and the stain-resistant coating layer stacked in two steps, excellent water resistance, stain resistance and air permeability can be exhibited.

8 Claims, 2 Drawing Sheets
(2 of 2 Drawing Sheet(s) Filed in Color)

(56) References Cited

FOREIGN PATENT DOCUMENTS

| | | | |
|---|---|---|---|
| JP | 07041731 | A | 2/1995 |
| JP | 2004019016 | A | 1/2004 |
| JP | 2009255044 | A | 11/2009 |
| JP | 2010069850 | A | 4/2010 |

OTHER PUBLICATIONS

Japan Patent Office, Communication dated Nov. 18, 2014, issued in corresponding Japanese Application No. 2014-523831.

The State Intellectual Property Office of the People's Republic of China, Communication dated Dec. 2, 2014, issued in corresponding Chinese Application No. 201280036564.X.

* cited by examiner

TEXTILE FABRIC SHEET HAVING STAIN AND LIQUID RESISTANCE AND THE PREPARATION METHOD THEREOF

CROSS-REFERENCE TO RELATED APPLICATIONS

This application is based on and claims priority to U.S. patent application Ser. No. 13/197,986, filed Aug. 4, 2011, now U.S. Pat. No. 8,795,780 disclosure of which is incorporated herein by reference in its entirety.

TECHNICAL FIELD

This invention relates to a textile fabric sheet having stain and liquid resistance and a method of preparing the same, and more particularly, to a fabric sheet with excellent stain resistance, wear resistance as well as liquid barrier characteristics prepared by sequentially forming a polyurethane skin layer and a stain-resistant coating layer on at least one surface of the fabric substrate and a method of preparing the same.

BACKGROUND

Generally, a textile fabric for interior application is being used for several years once installed. When they are contaminated by stains and spills, it is difficult to clean them every time, and these stains may leave bad marks on the surface, not good for aesthetics. Common stains include the ones caused by ball point pens, permanent marker, various liquids, solid or dust, impurities or other organic materials. Liquid stains or spills often seep through the open texture of the textile fabrics into the bottom cushion/foam underneath, and cause unsanitary environment in public places like hospitals, hotels, and restaurants.

To solve the above-mentioned issues, conventional stain resistant textiles are treated with stain resistant coating on the surface, and, if necessary, together with moisture barrier layer in the back of the fabric. However, when stain resistant coating is simply treated on the surface of the textile fabric, the effect is quite limited, not as good as other solid surface products, due to an open constructional characteristic of the textile fabric. Thus, it has been constantly required to develop a true stain resistant textile fabric that can be easily cleaned leaving no bad marks behind regardless of the type of stains.

SUMMARY

This invention has been made in an effort to provide a textile fabric sheet having an excellent stain, liquid and wear resistance, not sacrificing a true textile feel, which includes a skin layer—capable of providing a solid material base, on which stain resistance coating can be applied, acting as a liquid barrier with added wear resistance characteristics—and a coating layer on top having stain resistance and a method of preparing the same.

An exemplary embodiment of the present invention provides a textile fabric sheet having stain and liquid resistance, including: a fabric substrate; a polyurethane coating layer formed on the fabric substrate; and a stain-resistant coating layer formed on the polyurethane coating layer.

Herein, the fabric substrate may be pre-treated with a water repellent, an oil repellent, or both of them.

The fabric substrate may be a woven or non-woven fabric composed of at least one selected from the group consisting of a polyester fiber, a viscose rayon fiber, a polyamide fiber, a polyurethane fiber, an acrylic fiber, a polyolefin fiber and a cellulose fiber.

The polyurethane coating layer may have a thickness of 1 to 200 μm, and the stain-resistant coating layer may have a thickness of 1 to 30 μm.

A polyurethane resin used in the polyurethane coating layer may have an average molecular weight (Mw) of 10,000 to 700,000.

Another exemplary embodiment of the present invention provides a method of preparing a textile fabric sheet having stain and liquid resistance, comprising: (i) knife-coating a polyurethane coating composition at least once on one surface of a fabric substrate and drying the polyurethane coating composition; and (ii) coating a stain-resistant coating composition on a surface of the coated polyurethane coating layer and drying the stain-resistant coating composition.

In step (i), the fabric substrate may be knife-coated twice with the polyurethane coating composition. Here, a diameter angle of the knife may be 20 to 90 degrees.

The polyurethane coating composition may include a polyurethane resin at 10 to 100 g/m$^2$.

The stain-resistant coating composition may include a mixture of (i) a urethane resin, (ii) a silicon resin, (iii) inorganic particles, and (iv) an organic solvent. Here, the stain-resistant coating composition may comprise (i) a urethane resin in an amount of 20-40 parts by weight, (ii) a silicon resin in an amount of 1-10 parts by weight, (iii) inorganic particles in an amount of 1-10 parts by weight, and (d) an organic solvent in an amount to balance the stain-resistant coating composition to 100 parts by weight, based on 100 parts by weight of the coating composition.

In one embodiment of the method of preparing a textile fabric sheet according to the present invention, further comprises step of dip coating the fabric substrate with a coating solution containing a water repellent or an oil repellent and then drying it, before step (i).

According to the exemplary embodiments of the present invention, the textile fabric sheet having stain and liquid resistance can exhibit a texture characteristic of a fabric substrate itself and also exhibit water resistance, stain resistance and wear resistance due to a polyurethane coating layer and a stain-resistant coating layer formed in two layers.

In addition, according to the exemplary embodiments of the present invention, when used as surface finishing materials of furniture or interior, the textile fabric sheet is less flawed due to good surface hardness, and is not easily stained by stains in everyday life, and the stains can be easily removed.

Moreover, according to the exemplary embodiments of the present invention, since the polyurethane coating layer prevents a liquid from permeating into the fabric sheet, unlike a conventional stain resistant product, a separate moisture barrier is not needed, which is more economical.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

The exemplary embodiments of the present invention will be described in detail with reference to the accompanying drawings.

Hereinafter, the expression "B formed above (or below) A" or "B formed on A" used herein includes all of cases when B is directly attached to a top or bottom surface of A, when B is attached to a top or bottom surface of A by means of an adhesive layer or pressure-sensitive adhesive layer, and when at least one separate layer is formed on a top or bottom surface of A and B is attached to the separate layer directly or by means of an adhesive layer or a pressure-sensitive adhesive layer, etc.

Figure 1:
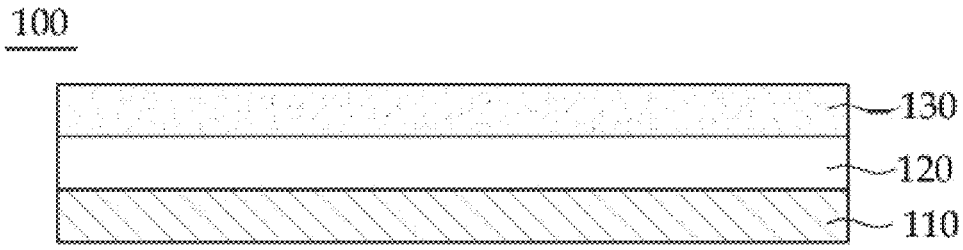
FIG. 1 is a cross-sectional view showing a configuration of a textile fabric sheet having stain and liquid resistance according to an exemplary embodiment of the present invention.

FIG. 1 is a cross-sectional view of a textile fabric sheet having stain and liquid resistance according to an exemplary embodiment of the present invention. Referring to FIG. 1, a textile fabric sheet having stain and liquid resistance 100 may sequentially comprise a fabric substrate 110 woven with fabric, and a polyurethane coating layer 120 and a stain-resistant coating layer 130 formed on one surface of the fabric substrate 110.

A kind of the fabric substrate 110 used herein is not particularly limited, and thus a conventional woven or non-woven fabric known to those skilled in the art may be used.

The woven or non-woven fabric may be prepared with synthetic resin fibers such as a polyester fiber, a viscose rayon fiber, a polyamide fiber, a polyurethane fiber, an acrylic fiber, a polyolefin fiber and a cellulose fiber, alone or in combination; cotton (e.g., thread made of cotton); or a combination of the synthetic resin fiber and cotton. Among these, a woven fabric prepared with a mixture of the polyester fiber or the viscose rayon fiber, the polyamide fiber, the polyester fiber and the cotton, or the polyester fiber and the viscose rayon fiber is preferably used, but the present invention is not limited thereto. A polyester textile material is woven using a polyester fiber stretched to have very little or reduced elongation, and has high tension, low absorption and excellent drug resistance. In addition, an elastic fiber material such as spandex may be used.

A method of preparing woven or non-woven fabric using the above-mentioned material may be, but is not particularly limited to, a general paper-manufacturing or weaving process.

The fabric substrate 110 may have a thickness of 0.3 to 2 mm, but the present invention is not limited thereto.

The present invention uses a fabric substrate itself 110 or a fabric substrate pre-treated with a water repellent, an oil repellent or both of them. Herein, the fabric substrate pre-treated with the water repellent 110 shows an excellent water repellent effect. Further, the pre-treated fabric substrate 110 not also reduces significantly a coating quantity of a coating layer to be formed subsequently but also exhibits a true textile feel. For these reasons, it is preferable to use the fabric substrate pre-treated with either or both of the water repellent and the oil repellent.

The fabric substrate pre-treated with the water repellent may be manufactured by a conventional method known to one skilled in the art. In one embodiment of the method for manufacturing the pre-treated fabric substrate, the fabric substrate pre-treated with the water repellent may be prepared by dip-coating the fabric substrate with a coating solution containing a water repellent or an oil repellent. The fabric substrate as prepared above forms a coating layer comprising a water repellant, an oil repellant or both of them on one surface or both surfaces of the substrate.

The water repellent of the present invention may comprise conventional water repellents known in the art. Non-limiting examples of the water repellent which can be used herein include a silicon-based water repellent, a fluoro-based water repellent, or mixture thereof. Particularly, it is preferable to use a fluoro-based water repellent.

A fluoro-based water repellent forms a fluro passivation layer on the surface of the fabric substrate and depresses a surface tension, thereby showing a remarkable water repellency. And since the fluro-based water repellent has an oil repellent as well as a water repellent, it has a more advantageous effect over other water repellents and may be used as an anti-dust agent. Non-limiting examples of the fluoro-based water repellent may include perfluoro acrylate-based copolymer.

The polyurethane coating layer 120 of the present invention may closely penetrate into the fabric substrate 110 while maintaining a web structure of the above mentioned fabric substrate 110 and may be thinly coated, thus exhibiting an original texture characteristic of the textile itself. In addition, the polyurethane coating layer 120 may prevent damage to the fabric substrate 110, and exhibit improved wear resistance and excellent water resistance because liquid does not permeate thereinto.

The polyurethane coating layer 120 may be formed using a conventional polyurethane resin known in the art. Non-limiting examples of the polyurethane resin may include polyether polyurethane, polyester polyurethane, polycarbonate polyurethane, polyetherester polyurethane, polyethercarbonate polyurethane, polycaprolactone polyurethane, hydrocarbon polyurethane, alicyclic polyurethane, aromatic polyurethane, or a combination of at least one thereof.

The polyurethane resin may have a weight average molecular weight (Mw) of 10000 to 700000, but the present invention is not limited thereto.

The polyurethane coating layer 120 may have a thickness of 1 to 200 μm. When the thickness of the polyurethane coating layer 120 is in the above-mentioned range, the polyurethane coating layer may exhibit an excellent coating effect, and have a fast drying speed and good workability.

The polyurethane coating layer 120 may be a transparent type or a colored type including a pigment. Generally, the fabric substrate 110 may have various colors and patterns, and thus a transparent polyurethane coating layer is preferably used to show such color and pattern as they appear originally.

Here, a pigment may be any one known in the art, for example, a pigment containing an organic or inorganic component, without limitation.

The stain-resistant coating layer 130 of the present invention may be formed on the polyurethane coating layer 120 and thus may exhibit excellent stain resistance and wear resistance.

The stain-resistant coating layer 130 may be formed using a general stain-resistant material known in the art. Non-limiting examples of the stain-resistant material include silicon resin, urethane resin or a mixture thereof. The silicon resin or urethane resin may be a conventional one known in the art without limitation. The silicon resin may have an average viscosity of 1000 to 20000 cps, but the present invention is not limited thereto. Further, the urethane resin may have an average viscosity of 1,000 to 20,000 cps/25° C., preferably 3,000 to 15,000 cps/25° C., more preferably 8,000 to 15,000 cps/25° C.

The stain-resistant coating layer 130 may comprise general inorganic particles known in the art. Non-limiting examples of inorganic particles which can be used herein include silica ($SiO_2$), alumina ($Al_2O_3$), $SnO_2$, MgO, CaO, $TiO_2$ or mixture thereof.

The stain-resistant coating layer 130 may have a thickness of 1 to 30 μm. When the thickness of the stain-resistant coating layer 130 is in the above-mentioned range, the stain-resistant coating layer 130 may exhibit an excellent coating effect, and have a fast drying speed and good workability.

The textile fabric sheet having stain and liquid resistance according to the exemplary embodiment of the present invention may be prepared according to a method to be described below, but the present invention is not particularly limited thereto.

In the exemplary embodiment, the method may include (i) knife-coating a polyurethane coating composition at least once on one surface of a fabric substrate and drying the composition; and (ii) coating a stain-resistant coating composition on a top surface of the coated polyurethane coating layer and drying the composition.

Knife coating is one of coating methods used when a fabric material is laminated. That is, a fabric substrate is provided on a revolving roller to move, a liquid coating composition is provided on the moving fabric substrate, and the provided liquid coating composition passes through a knife extending in a width direction and formed on the roller. Here, the thickness of the coating layer is determined according to a height of the knife.

Meanwhile, when the polyurethane coating layer is very thick, the final textile fabric sheet becomes rigid, and thus is deteriorated in texture as textiles. Thus, in the present invention, a polyurethane coating composition and a stain-resistant coating composition are sequentially coated on a fabric substrate using knife coating. Here, the coating composition may be thinly coated at least twice to maintain air permeability of the fabric substrate and soft texture.

In the exemplary embodiment, each of the polyurethane coating composition and the stain-resistant coating composition may be knife-coated once or at least twice. The polyurethane coating composition is preferably knife-coated at least twice. Here, a diameter angle of the knife, a thickness of the knife and a viscosity of the coating composition may be appropriately controlled in consideration of texture, wear resistance and stain resistance of the final fabric sheet of the present invention.

During the knife coating, the diameter angle of the knife may be 20 to 90 degrees. Generally, as the knife angle is decreased and the knife thickness is increased, a coating layer to be formed has a larger thickness. Considering this, when the coating composition is coated at least twice, the diameter angle of the knife in the first coating step may be larger than the diameter angle of the knife in the second coating step, and thus the coating composition may be thinly coated. Actually, the thickness of the coating layer to be formed may be controlled by adjusting the viscosity of the coating composition, the knife angle or the knife thickness, and thus a polyurethane resin or stain-resistant resin may be thinly and uniformly applied to a surface of the fabric substrate to have a predetermined thickness. In addition, an applying amount of the coating composition may be reduced, and excellent adhesive strength may be ensured.

The polyurethane coating composition according to the exemplary embodiment of the present invention may be a liquid resin composition including a urethane resin selected according to a material of the substrate, a curing agent and an organic solvent. As an example, the urethane resin and the curing agent are dispersed in the organic solvent and diluted at an appropriate concentration, thereby preparing the polyurethane coating composition.

The curing agent and the organic solvent may be any of conventional ones known in the art without limitation. Non-liming examples of the solvent which can be used herein may be a ketone-based solvent such as methylethylketone (MEK), methylisobutylketone (MIBK) or acetone; an alcohol-based solvent such as isopropylalcohol (IPA) or n-hexanol; or 1,2-dichlorobenzen, N-methylpyrrolidone (NMP) or N,N-dimethylformamide (DMF). When necessary, the polyurethane coating composition may further include a reinforcing filling agent or weight filling agent, for example, colloidal silica, fumed silica; a coloring agent and a pigment; a thermal stabilizer, a UV stabilizer and a weather stabilizer; a flame retardant, a thickening agent, an herbicide or a preservative.

The viscosity of the polyurethane coating composition to use the knife coating method may be 1000 to 20000 cps, but the present invention is not particularly limited thereto. Here, the polyurethane coating composition may contain a polyurethane resin at 10 to 100 g/$m^2$.

The polyurethane coating layer formed as described above is exposed to air for sufficient time, thereby forming a cured film. Here, drying time and conditions may be adjusted within a conventional range. For example, the drying may be performed at room temperature or approximately 80 to 250° C. for 1 to 24 hours.

A stain-resistant coating composition is knife-coated on the formed polyurethane coating layer, and then dried.

A silicon resin generally has a very high viscosity, and thus is not suitable for knife coating and does not easily form a uniform coating layer even if coated. For these reasons, the present invention uses a stain-resistant coating composition suitable for a knife-coating method, because a silicon resin is contained in a minor amount.

The stain-resistant coating composition according to the exemplary embodiment of the present invention may be a combination of (i) a urethane resin, (ii) a silicon resin, (iii) inorganic particles, and (iv) an organic solvent.

Specifically, the stain-resistant coating composition preferably comprises (i) a urethane resin in an amount of 20-40 parts by weight, (ii) a silicon resin in an amount of 1-10 parts by weight, (iii) inorganic particles in an amount of 1-10 parts by weight, and (d) an organic solvent in an amount to balance the stain-resistant coating composition to 100 parts by weight, based on 100 parts by weight of the stain-resistant coating composition.

The uniformly mixed stain-resistant coating composition preferably have a viscosity of 8,000 to 15,000 cps/25° C.

In the present invention, the stain-resistant coating composition may further comprise an additive capable of reducing the viscosity of the silicon resin. Non-liming examples of the additive which can be used herein may be at least one additive selected from the group consisting of oil, platinum and fluorine. There is no particular limitation in content of the additive as long as the additive is capable of reducing viscosity of the silicon resin in the stain-resistant coating composition.

In the formation of the stain-resistant coating layer, knife coating, coating conditions and drying conditions may be the same as those used in the formation of the polyurethane coating layer described above. Here, when the stain-resistant coating layer is coated at least twice, a solid content of the stain-resistant coating composition in the second coating step may be lower than that in the first coating step.

The textile fabric sheet according to the exemplary embodiment of the present invention prepared as described above may have a structure in which the web structure of the fabric substrate woven with a fiber is preserved, and the reduction in air permeability of the final textile fabric sheet according to the introduction of the coating layer may be minimized.

Meanwhile, in the present invention, the polyurethane coating layer 120 and the stain-resistant coating layer 130 are sequentially formed on the fabric substrate 110. However, the number and stacking sequence of coating layers constituting the textile fabric sheet having stain and liquid resistance may be freely selected according to a purpose, which is also included in the scope of the present invention.

As an example, a multi-layered structure having at least three layers may be formed by changing the sequence of the coating layers 120 and 130 or introducing a different surface layer. Here, a detachable film may be formed on the other surface of the fabric substrate 110, and further include a surface layer on a top surface of the stain-resistant coating layer. Like this, as the detachable film and surface layer are additionally formed, shape stability of the textile fabric sheet having stain and liquid resistance may be ensured, and surface damage due to friction may be prevented.

The textile fabric sheet having stain and liquid resistance according to the exemplary embodiment of the present invention may be applied to various interior or exterior products. The interior products can be applied to all products to which the textile fabric sheet having stain and liquid resistance will be introduced, and unlimited examples thereof may include wall paper, furniture, flooring materials, interior materials, exterior materials, surface materials, wood or interior accessories.

Hereinafter, the present invention will be described in detail with reference to Examples. However, these Examples are merely provided to describe the present invention, not to limit the scope of the present invention.

Example 1

Preparation of Textile Fabric Sheet having Stain and Liquid Resistance

A polyurethane coating composition (viscosity: 5000-7000 cps) including a polyurethane resin having a molecular weight of 20000 to 200000 and a solvent mixture of MEK, EA and TO was first knife-coated on a polyester fabric. Here, a knife angle was 30 to 60 degrees, drying was performed at 100° C. for 1 to 5 minutes, and second knife coating was performed, thereby forming a final polyurethane coating layer having a thickness of 10 to 100 μm. A stain-resistant coating composition in which a polyurethane resin, a silicon resin, inorganic particles (silica) and solvent were mixed in a weight ratio of 25:3:3:69 was knife-coated on the coated polyurethane, and dried at 100 to 220° C. for 10 to 24 hours, thereby preparing a textile fabric sheet having stain and liquid resistance (ZENUS-GRAFFITI-FREE FABRIC®).

Example 2

Preparation of Textile Fabric Sheet having Stain and Liquid Resistance

A coating composition in which perfluoroacrylate-based copolymer, isopropyl alcohol and a solvent were mixed in a weight ratio of 30:4:66 was used as water repellent coating solution. A polyester fabric was pre-treated with the water repellent coating solution by dip-coating process and then drying it. Then, a polyurethane coating composition was knife-coated twice on the surface of the pre-treated polyester fabric obtained as described above, thereby forming a final polyurethane coating layer. A stain-resistant coating composition in which a polyurethane resin, a silicon resin, inorganic particles (silica) and a solvent were mixed in a weight ratio of 25:3:3:69 was knife-coated on the coated polyurethane, and dried at 100 to 220° C. for 10 to 24 hours, thereby preparing a textile fabric sheet having stain and liquid resistance (ZENUS-GRAFFITI-FREE FABRIC®).

Experimental Example 1

Evaluation of Physical Property of Textile Fabric Sheet having Stain and Liquid Resistance 1) Evaluation of Stain Resistance Evaluation of stain resistance was performed using the textile fabric sheet having stain and liquid resistance prepared in Examples 1 and 2.

The evaluation method was repeatedly performed 50 times using the same stains to evaluate a degree of staining by eyes. Here, as the stains, an oil-based ballpoint pen and mustard, stains from which are the most difficult to prevent, were used. In addition, as a control group, a fabric sheet 1 (pattern: Space pod, color: Havana) and a fabric sheet 2 (pattern: Teleport stripe, color: Retro) currently produced by Crypton were used.

Figure 2:
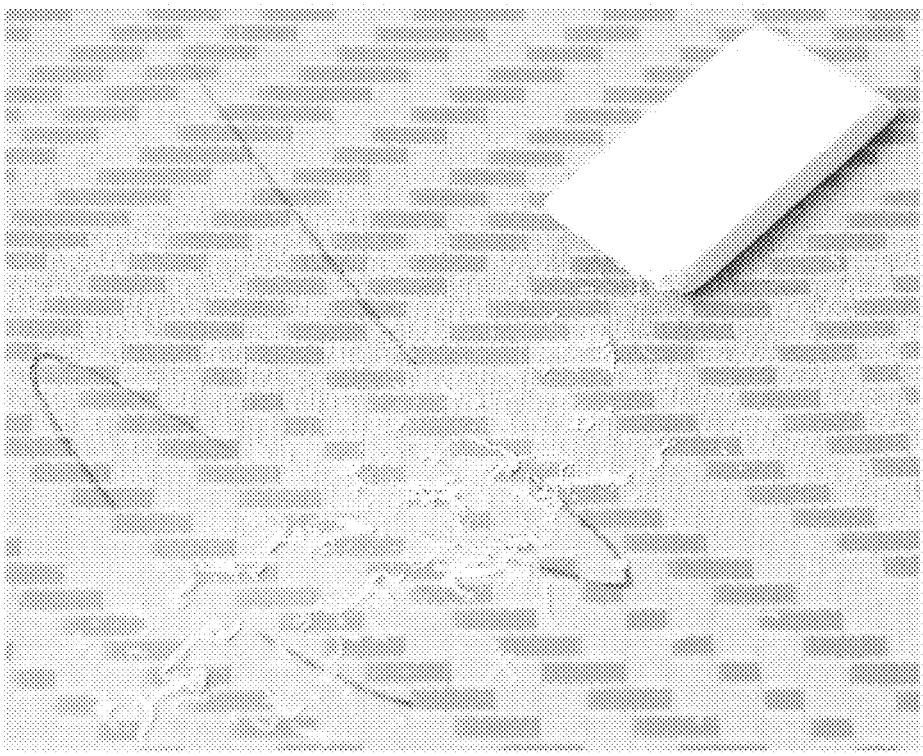
FIG. 2 is a photograph showing the result of evaluating the stain resistance of a textile fabric sheet having stain and liquid resistance according to an exemplary embodiment of the present invention.
Figure 3:
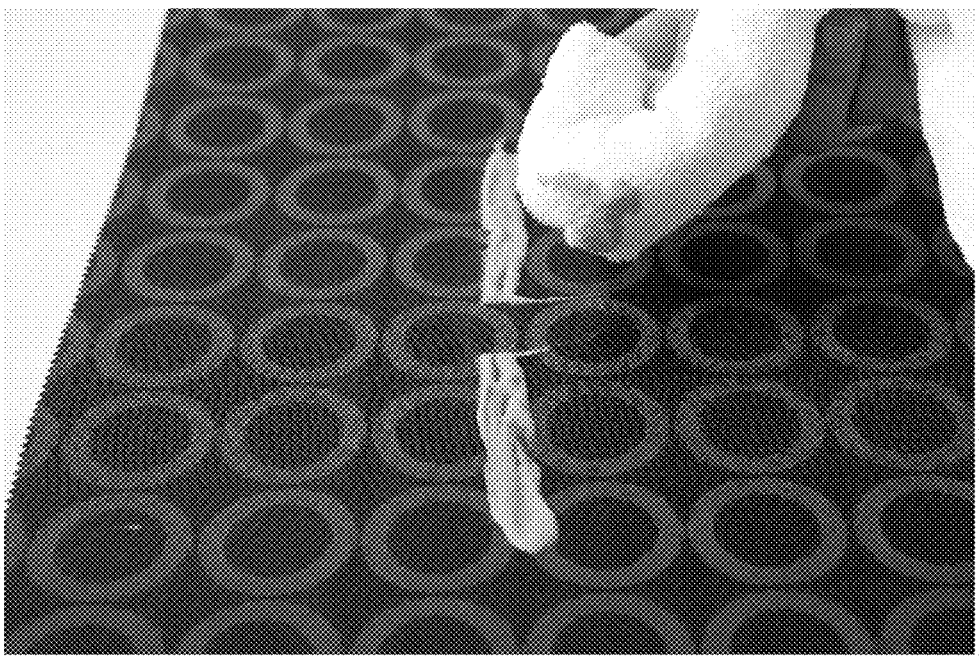
FIG. 3 is a photograph showing the result of evaluating the stain resistance of a textile fabric sheet having stain and liquid resistance according to an exemplary embodiment of the present invention.

As a result, the ballpoint pen on the fabric sheets in Examples 1 and 2 was easily removed with an eraser and a fabric or paper towel without using a specific cleaner (see FIG. 2). The mustard thereon was also completely removed with a fabric or paper towel without using a specific cleaner (see FIG. 3).

On the other hand, it was impossible to remove the ballpoint pen and the mustard on the fabric sheets of the control group in the same manner as in Examples 1 and 2 above. The mustard stains were left thereon. Therefore, it can be noted that the textile fabric sheet of the present invention had a more excellent stain resistant effect than the control group.

2) Evaluation of Water Repellent

Evaluation of water repellent was performed using the textile fabric sheet having stain and liquid resistance prepared in Examples 1 and 2.

The evaluation method was performed using water to evaluate the shape of the instilled water and/or the absorption degree of the textile fabric sheet by eyes after instillation of water into the textile fabric sheet.

Figure 4:
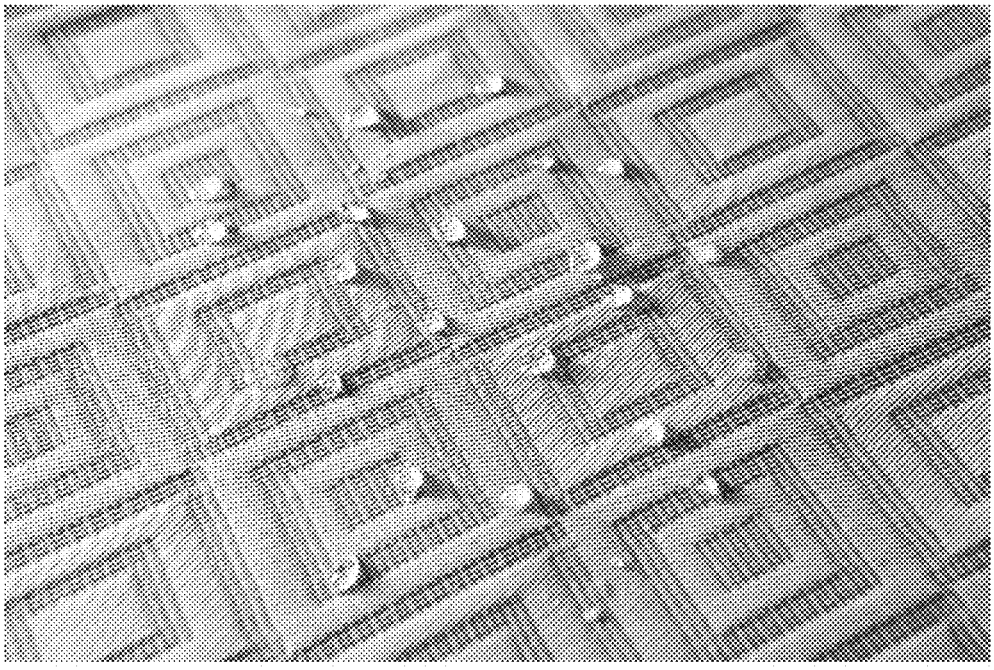
FIG. 4 is a photograph showing the result of evaluating the water repellent of a textile fabric sheet having stain and liquid resistance according to an exemplary embodiment of the present invention.

As a result, the instilled water on the fabric sheet prepared in Examples 1 and 2 existed maintaining the fundamental shape thereof as time passed and was not absorbed into the fabric sheet. Therefore, it can be noted that the fabric sheet of the present invention had an excellent water repellent effect (see FIG. 4).

3) Evaluation of Wear Resistance (Friction Fastness)

The textile fabric sheet having stain and liquid resistance of Examples 1 and 2 were tested according to an ASTM D4157 Wyzenbeek method. Here, as a control group, fabric sheets 1 and 2 produced by Crypton used in the Evaluation of Stain Resistance were used.

Generally, when a result of the wear resistance test was 30000 rubs or more, it was indicated as heavy duty, and when a result of the wear resistance test was more than 50000 rubs, it is determined as commercially suitable.

The results of the test were that the fabric sheet produced by Crypton withstood 80000 rubs (1) and 50000 rubs (2), respectively, and the textile fabric sheet having stain and liquid resistance of the present invention withstood more than 200000 rubs. It can be confirmed that, regardless of abrasion of the textile, due to the polyurethane coating layer formed on its surface, the wear resistant effect was drastically improved.

4) Evaluation of Wear Resistance (Friction Fastness) (2)

Evaluation of wear resistance was performed at Diverisified Testing Laboratories, INC. using various textile fabric sheets prepared in above Examples. The textile fabric sheets were tested according to an ASTM D4157-10 Oscillatory Cylinder Method (Standard Test Method for Abrasion Resistance of Textile Fabrics). And the Evaluation of wear resistance was performed in the condition of abradant: #8 Cotton duck; tension: 4 lb; load: 3 lb.

As a result, the textile fabric sheet having stain and liquid resistance of the present invention withstood more than 200,000 rubs. Therefore, it can be noted that the textile fabric sheet of the present invention had an excellent wear resistance effect (see Table 1).

TABLE 1

| Sample | Test Results |
|---|---|
| ZENUS ® KASKADE | Passed 200,000 Cycles |
| ZENUS ® MOSAIC | Passed 200,000 Cycles |
| ZENUS ® VENDETTA | Passed 200,000 Cycles |
| ZENUS ® CITADEL | Passed 200,000 Cycles |
| ZENUS ® ORACLE | Passed 200,000 Cycles |

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A textile fabric sheet having stain and liquid resistance, comprising:

a fabric substrate;

a polyurethane coating layer of a thickness of 1 to 200 μm formed on one surface of the fabric substrate; and a stain-resistant coating layer of a thickness of 1-30 μm formed on the polyurethane coating layer, wherein the fabric substrate is pre-treated with a water repellent, an oil repellent or both of them;

wherein the polyurethane coating layer is formed from a composition consisting of a polyurethane resin, a curing agent and an organic solvent; and wherein the stain-resistant coating layer comprises a mixture of a urethane resin, a silicon resin, inorganic particles and an organic solvent.

2. The textile fabric sheet of claim 1, wherein the fabric substrate is a woven or non-woven fabric composed of at least one selected from the group consisting of a polyester fiber, a viscose rayon fiber, a polyamide fiber, a polyurethane fiber, an acrylic fiber, a polyolefin fiber and a cellulose fiber.

3. The textile fabric sheet of claim 1, wherein the polyurethane resin has an average molecular weight (Mw) of 10,000 to 700,000.

4. A method of preparing a textile fabric sheet having stain and liquid resistance, said textile fabric sheet comprising a fabric substrate, a polyurethane coating layer and a stain-resistant coating layer in this order, said method comprising:

(i) providing the fabric substrate;

(ii) dip coating a surface of the fabric substrate with a coating solution comprising a water repellent, an oil repellent or both of them and drying the coating solution to give a pre-treated fabric substrate;

(iii) knife-coating one surface of the pre-treated fabric substrate with a composition at least once and drying the composition to give a fabric substrate of which one surface is coated with the polyurethane coating layer of a thickness of 1 to 200 μm, wherein the composition is consisting of a polyurethane resin, a curing agent and an organic solvent; and (iv) applying to the polyurethane-coated surface of the fabric substrate a stain-resistant coating composition comprising a mixture of a urethane resin, a silicon resin, inorganic particles, and an organic solvent and drying the stain-resistant coating composition to form the stain-resistant coating layer of a thickness of 1 to 30 μm, which gives the textile fabric sheet having stain and liquid resistance.

5. The method of claim 4, wherein, in step (iii), the knife-coating is performed twice.

6. The method of claim 4, wherein, during the knife coating, a diameter angle of a knife is 20 to 90 degrees.

7. The method of claim 4, wherein the polyurethane coating layer includes the polyurethane resin at an amount of 10 to 100 $g/m^2$.

8. The method of claim 7, wherein the stain-resistant coating composition comprises the mixture of the urethane resin in an amount of 20-40 parts by weight, the silicon resin in an amount of 1-10 parts by weight, the inorganic particles in an amount of 1-10 parts by weight, and the organic solvent in an amount to balance the stain-resistant coating composition to 100 parts by weight, based on 100 parts by weight of the coating composition.

* * * * *